US008227985B2

(12) United States Patent
Shurter et al.

(10) Patent No.: US 8,227,985 B2
(45) Date of Patent: Jul. 24, 2012

(54) PHOTO-STIMULATED LOW ELECTRON TEMPERATURE HIGH CURRENT DIAMOND FILM FIELD EMISSION CATHODE

(75) Inventors: Roger Philips Shurter, Los Alamos, NM (US); David James Devlin, Santa Fe, NM (US); Nathan Andrew Moody, Los Alamos, NM (US); Jose Martin Taccetti, Santa Fe, NM (US); Steven John Russell, Los Alamos, NM (US)

(73) Assignee: Los Alamos National Security, LLC, Los Alamos, NM (US)

( * ) Notice: Subject to any disclaimer, the term of this patent is extended or adjusted under 35 U.S.C. 154(b) by 0 days.

(21) Appl. No.: 13/204,008

(22) Filed: Aug. 5, 2011

(65) Prior Publication Data

US 2012/0032576 A1 Feb. 9, 2012

Related U.S. Application Data

(60) Provisional application No. 61/371,510, filed on Aug. 6, 2010.

(51) Int. Cl.

| | |
|---|---|
| ***H01J 9/02*** | (2006.01) |
| ***H01J 21/00*** | (2006.01) |
| ***H01J 5/16*** | (2006.01) |
| ***H01J 1/34*** | (2006.01) |

(52) U.S. Cl. ..... 313/542; 313/103 R; 313/386; 313/387

(58) Field of Classification Search ..... 313/306, 313/309–310, 495–497, 293–304, 542, 103 R, 313/386, 387; 445/24; 977/939; 250/493 P
See application file for complete search history.

(56) References Cited

U.S. PATENT DOCUMENTS

| | | | | |
|---|---|---|---|---|
| 5,583,393 | A | 12/1996 | Jones | |
| 6,400,091 | B1 | 6/2002 | Deguchi et al. | |
| 6,538,368 | B1 * | 3/2003 | Fox et al. | 313/311 |
| 6,650,061 | B1 | 11/2003 | Urayama et al. | |
| 7,455,754 | B2 * | 11/2008 | Wesner et al. | 204/294 |
| 8,075,360 | B2 * | 12/2011 | Teramoto et al. | 445/51 |
| 2005/0092929 | A1 | 5/2005 | Schneiker | |
| 2006/0001360 | A1 * | 1/2006 | Tatsumi et al. | 313/497 |
| 2006/0033417 | A1 * | 2/2006 | Srinivasan-Rao et al. | 313/399 |
| 2006/0087248 | A1 | 4/2006 | Konishi et al. | |
| 2006/0113891 | A1 * | 6/2006 | Nishimura et al. | 313/496 |
| 2006/0175953 | A1 * | 8/2006 | Swain et al. | 313/311 |

(Continued)

OTHER PUBLICATIONS

Carbon Nanotube Based Transparent Conductive Coatings P. Glatkowski Society for the Advancement of Material and Process Engineering Proceedings, 48 (2003) p. 2146.*

(Continued)

*Primary Examiner* — Anne Hines
*Assistant Examiner* — Jacob R Stern
(74) *Attorney, Agent, or Firm* — Juliet A. Jones; Samuel L. Borkowsky

(57) ABSTRACT

An electron source includes a back contact surface having a means for attaching a power source to the back contact surface. The electron source also includes a layer comprising platinum in direct contact with the back contact surface, a composite layer of single-walled carbon nanotubes embedded in platinum in direct contact with the layer comprising platinum. The electron source also includes a nanocrystalline diamond layer in direct contact with the composite layer. The nanocrystalline diamond layer is doped with boron. A portion of the back contact surface is removed to reveal the underlying platinum. The electron source is contained in an evacuable container.

9 Claims, 3 Drawing Sheets

U.S. PATENT DOCUMENTS

2007/0205710 A1* 9/2007 Sagawa et al. ..... 313/497
2007/0216284 A1* 9/2007 Takegami ..... 313/495
2007/0252507 A1* 11/2007 Jeong ..... 313/309
2008/0174229 A1* 7/2008 Jeong ..... 313/495
2008/0278062 A1* 11/2008 Moon et al. ..... 313/498
2009/0021136 A1* 1/2009 Coll et al. ..... 313/496
2009/0078851 A1* 3/2009 Watanabe et al. ..... 250/205
2009/0191367 A1* 7/2009 Chen ..... 428/34.1
2009/0310333 A1* 12/2009 Lee et al. ..... 362/84

OTHER PUBLICATIONS

McEuen, P.L. Single-wall carbon nanotubes. Phys. World 2000, 13(6), 31-36.*

* cited by examiner

PHOTO-STIMULATED LOW ELECTRON TEMPERATURE HIGH CURRENT DIAMOND FILM FIELD EMISSION CATHODE

RELATED APPLICATIONS

This application claims the benefit of U.S. Provisional Patent Application No. 61/371,510 entitled "A Photo-Stimulated Low Electron Temperature High Current Diamond Film Field Emission Cathode," filed Aug. 6, 2010, which is incorporated by reference herein.

STATEMENT OF FEDERAL RIGHTS

The United States government has rights in this invention pursuant to Contract No. DE-AC52-06NA25396 between the United States Department of Energy and Los Alamos National Security, LLC for the operation of Los Alamos National Laboratory.

FIELD OF THE INVENTION

The present invention relates to electron sources comprising nanostructured, polycrystalline diamond and single-walled carbon nanotubes, methods of use, and methods of making thereof.

BACKGROUND OF THE INVENTION

As a society, we routinely rely upon a broad class of devices known as vacuum electronics to help us communicate, understand weather, maintain air safety, image and diagnose medical conditions, sustain our national defense, and for other applications. These important devices utilize an electron beam to amplify or create radiation, and include the microwave tubes found in satellite and ground communications, x-ray tubes in medical imaging and airport screening systems, civilian and military microwave systems, cellular network nodes, etc. The technology has become central to defense and military systems, but those of skill in the art also recognize limitations which erode their ability to meet future needs. These limitations are directly tied to the method by which the requisite electron beams are created, which is now more than 50 years old.

Currently, two practical options exist to provide electron sources for the vacuum electronics industry: thermionic cathodes and photocathodes. Increasingly, though, new high-power, high-frequency (>100 GHz) devices are limited by the properties of these sources. Of particular concern are beam quality, lifetime and ruggedness.

Thermionic cathodes are typically made of pure tungsten, or barium or strontium oxides impregnated in a matrix of porous tungsten. They are a well known and reliable technology that has been used over many decades. However, they are limited to low current densities (<10 A/cm$^2$), requiring large cathode areas for high average or peak beam currents. Furthermore, they must be heated to high temperature (1400 K to 2500 K), which requires extra power and makes them susceptible to damage in poor vacuum environments, thus exacerbating emittance concerns. The high thermal gradients between the cathode and adjacent device components introduce expensive engineering challenges and results in undesirable transverse beam energies of 0.1 eV or greater. The combination of large cathode area and the transverse energy typically result in relatively low quality electron beams.

Photocathodes are a more recent development, able to source high current densities (100s of A/cm$^2$) with prompt emission, effectively imitating the shape of the laser pulse used to drive them. However, they require a sophisticated laser system, are limited to low average current, and typically emit thermally "hot" electrons (i.e., having about 1 eV transverse temperature) due to the difference between the laser photon energy and the work function of the photocathode material.

An ongoing need exists, therefore, for an electron beam source suitable for use with vacuum electronics which produces high beam quality, has good lifetime, and is low-maintenance.

SUMMARY OF THE INVENTION

The present invention describes a novel, ultra-high quality, robust electron source, which utilizes nanostructured polycrystalline diamond and comprises single-walled carbon nanotubes (SWCNs). The robust nature of diamond, with its high thermal conductivity (five times that of copper), makes it an ideal solution for applications in harsh environments and high duty cycle systems. By eliminating the heat requirement for thermionic emission and the drive laser requirement for photoemission, the diamond cathode of the present invention simplifies high power RF systems and extends their capabilities by at least an order of magnitude in terms of power and frequency.

The present invention may not only advance the stagnant state of the art, leading to immediate improvements across a burgeoning industry, but also may allow the development of a new generation of high power vacuum electronic devices (e.g., RE sources) that scale to higher power, shorter wavelength, improved efficiency, smaller form factor, and reduced cost. The diamond field emitter of the present invention can be tailored to any number of specific applications and can be used with essentially any vacuum electronic device, including high-frequency (>100 GHz) microwave tubes and advanced accelerator applications.

The following describe some non-limiting embodiments of the present invention.

According to one embodiment of the present invention, an electron source is provided, comprising a back contact surface; means for attaching one or more power sources to said back contact surface; a partially phototransparent layer in direct contact with said back contact surface; a layer comprising single-walled carbon nanotubes in direct contact with said partially phototransparent layer, wherein at least a portion of said single-walled carbon nanotubes and at least a portion of said partially phototransparent layer form a matrix; and, a doped nanocrystalline diamond layer in direct contact with said matrix; wherein, i) at least a portion of said back contact surface is removed to reveal the partially phototransparent layer;

ii) upon illumination of the partially phototransparent layer with a laser, said electron source emits a beam of electrons either concurrently with or subsequent to said illumination; and, iii) said electron source is contained in a vacuum.

DETAILED DESCRIPTION OF THE INVENTION

The present invention relates to an electron source comprising nanostructured, polycrystalline diamond and single-walled carbon nanotubes, methods of use, and methods of making thereof. The electron source of the present invention is derived from experiments in which diamond samples were subjected to a high electric field and subsequently illuminated by a laser beam to test their photo-emission characteristics. The samples were highly doped with boron to create a p-type semiconductor and surface terminated with hydrogen to create a negative electron affinity (NEA) surface. When illuminated, normal pulsed photoemission occurred in a predictable manner until the laser fluence reached a particular level, at which time the sample would continue to emit an electron beam even without the need for laser illumination and until the electric field was turned off.

"Electron beam quality," as used herein, refers to the area occupied by an electron beam in transverse phase space. For the purposes of the present invention, "high electron beam quality" means an emitted electron beam having a transverse energy of 0.2 eV or less.

"Partially phototransparent," as used herein, means translucent by from about 30 to about 50% at 532 nm (2.34 eV photon energy).

"Matrix," as used herein, means a composite of SWNTs partially or completely embedded in a thin layer comprising platinum.

"Vacuum," as used herein, means a pressure of $3\times10^{-6}$ torr or less.

"In direct contact," as used herein, means that the layers are situated directly upon one another, such that the addition of intervening layers is precluded.

Figure 1:
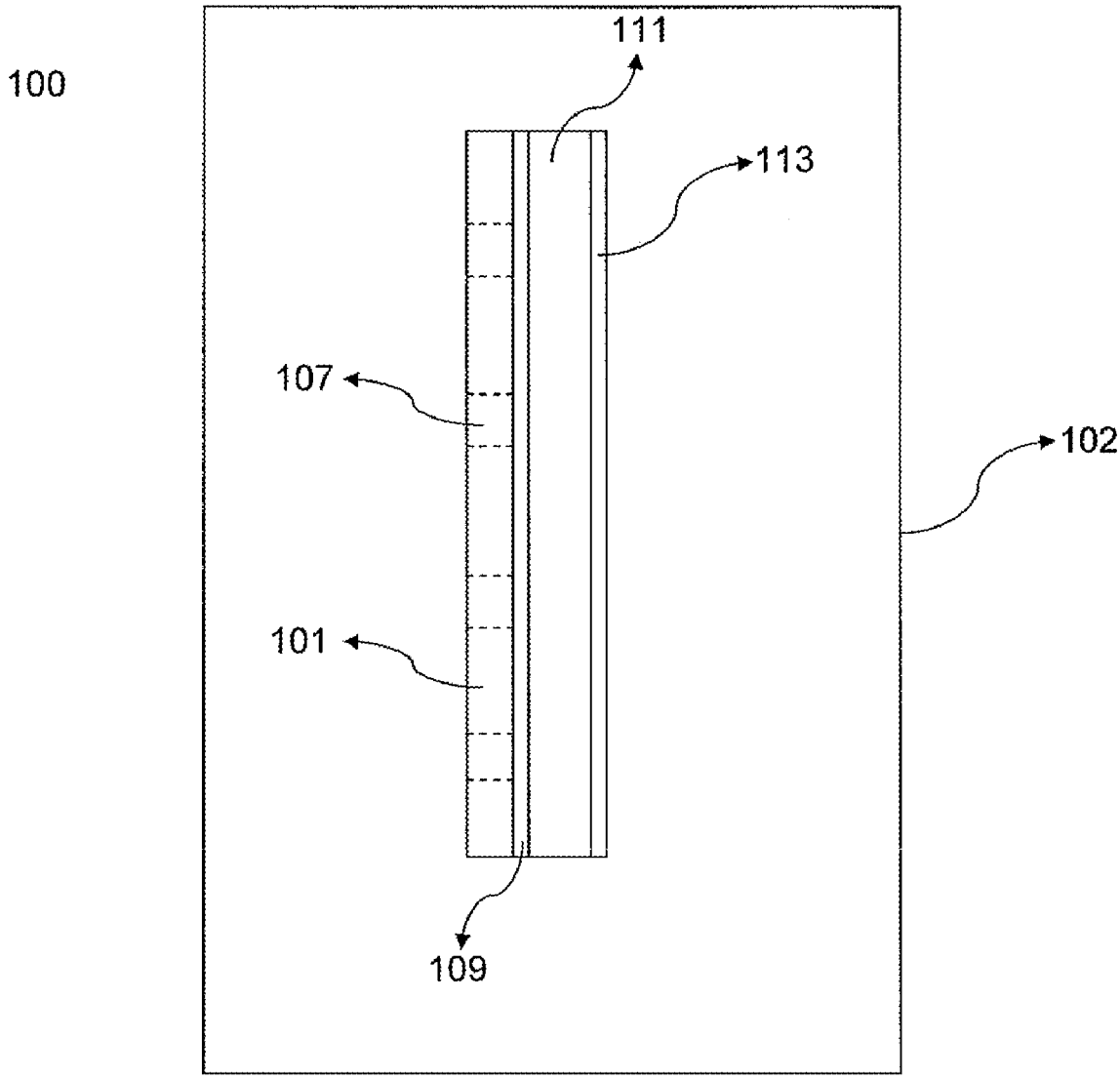
FIG. 1 depicts a side view showing the various layers of the electron source of the present invention.

FIG. 1 depicts one non-limiting embodiment of the electron source (100) of the present invention. The electron source is enclosed in vacuum, i.e., in a container or housing (102) suitable for maintaining a pressure of $3\times10^{-6}$ torr or less, and alternatively from about to $3\times10^{-6}$ torr to about $10^{-7}$ torr. It is noted that nanostructured diamond cathodes are able to operate under suitable conditions at such relatively moderate vacuum pressures due to the inert surface/vacuum interface. In contrast, both thermionic and photocathodes not comprising nanostructured diamond cathodes may require an ultra-high vacuum system (less than $1\times10^{-8}$ torr) to prevent the possibility of destructive surface chemistry with background gasses. This surface chemistry is exacerbated by the high temperature in the thermionic cathode, and by reaction with highly reactive alkali metal compounds present in photocathodes.

Figure 2:
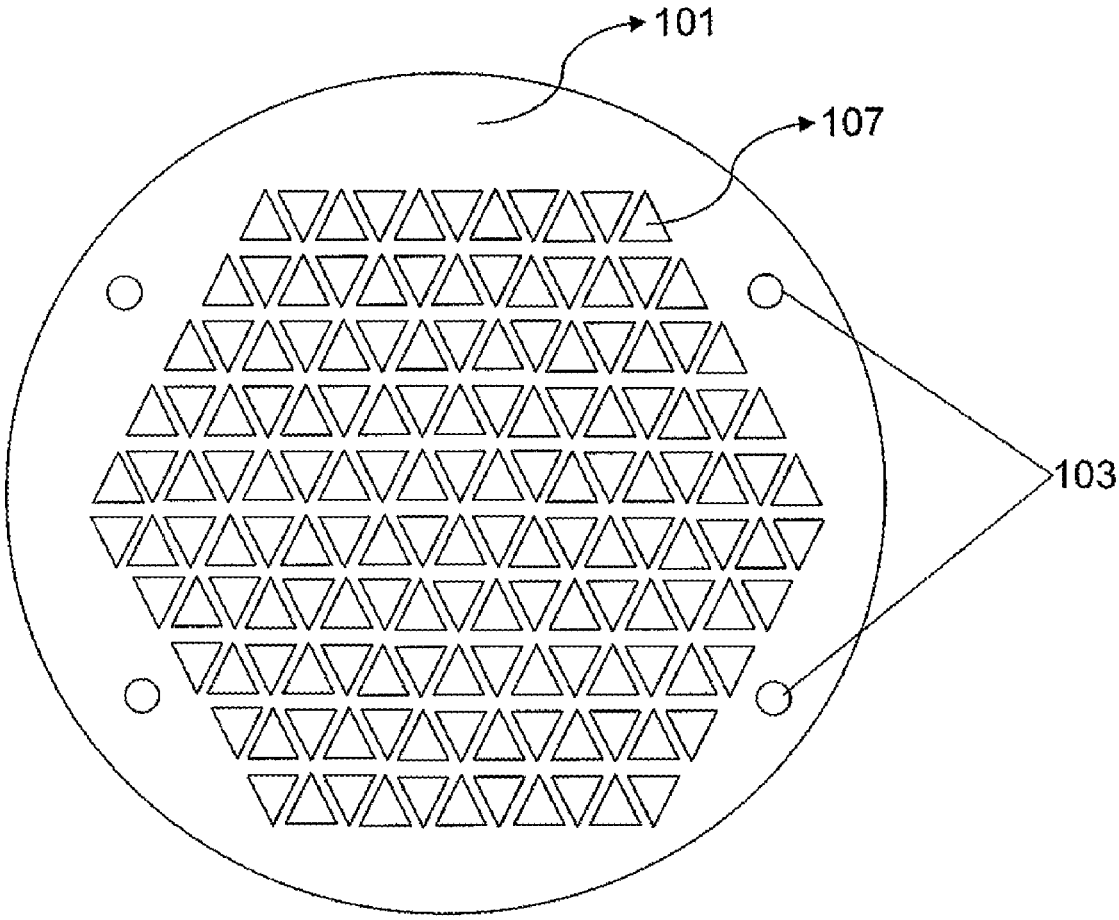
FIG. 2 depicts a frontal view of one (back) surface of the electron source of the present invention, which serves to uniformly distribute charge over the back surface of the cathode and is sufficiently thick to provide support for the handling of the source.

The electron source (100) comprises a back contact surface (101), which in turn comprises one or more means (103) for attaching a suitable power source. FIG. 2 depicts a frontal view of back contact surface (101). The power source may provide radiofrequency (RF), pulsed, or DC power input. The back contact surface (101) is comprised of a highly conductive, non-oxidative material suitable to uniformly distribute charge over the entire back surface of the electron source, and is sufficiently thick to provide some support for the handling of the device. The back contact surface (101) may comprise gold, palladium, or combinations thereof. In one embodiment, the back contact surface comprises gold. The back contact surface (101) has a thickness of from about 100 microns to about 1 millimeter. Portions (107) of the back contact surface (101) are etched away to allow laser illumination of an underlying (109). The back contact surface (101) may also be referred to as a support because it provides physical support for the layer (109) and other layers to be described below.

The layer (109) is comprised of platinum. Layer (109) may have a thickness of from 600 angstroms to 500 microns. In some embodiments, wherein the thickness of layer (109) is less than about 300 microns, layer (109) may be partially phototransparent. The thickness of layer (109) will depend upon the particular application for the electron beam source. For some applications, a thinner (e.g. 600 angstroms to 10 microns) layer would be desirable. Other applications may require a thicker layer, e.g. from 300 microns to 500 microns.

The layer (109) in turn is in direct contact with a composite layer (111) of single-walled carbon nanotubes (SWNTs) partially or completely embedded in platinum. SWNTs are known that have either semiconducting properties or metallic properties. The SWNTs used herein are the ones having metallic properties.

Figure 3:
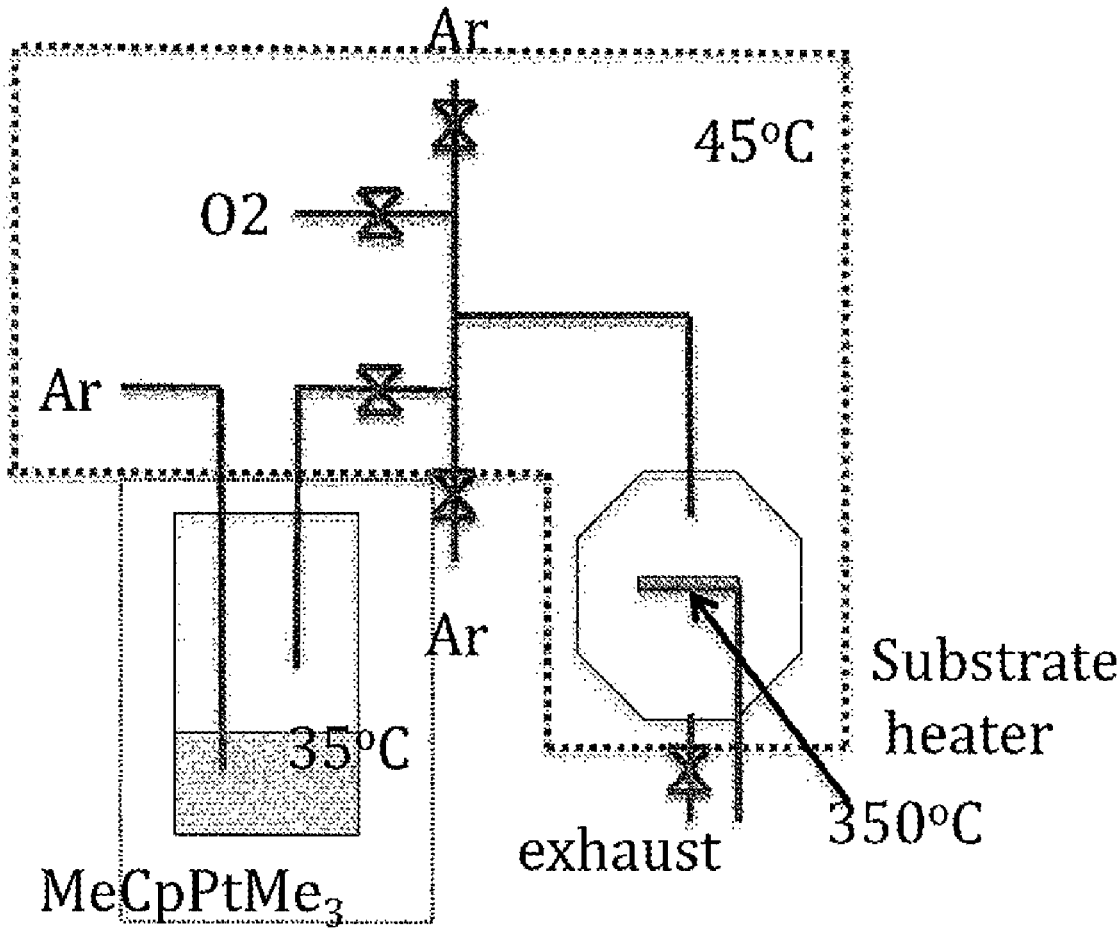
FIG. 3 shows a reactor system for depositing platinum on carbon nanotubes.

In an embodiment, the composite layer is prepared first. The composite layer may be formed by a chemical vapor deposition (CVD) process that begins with SWNTs and then depositing platinum on the SWNTs. These types of depositions typically use a platinum-containing precursor gas. An atomic layer deposition process is employed wherein a platinum-containing precursor gas is introduced into a reactor and a monolayer is allowed to adsorb on the substrate, which in this case would be the SWNTs. Excess precursor gas would be removed and a second species would be introduced that would react with the adsorbed monolayer to form the desired solid phase, which in this case would be the platinum. The second species in this case would be oxygen. The process is self-limiting and would be repeated to create multiple atomic layers of platinum on the SWNTs. In an embodiment, the platinum containing precursor gas may comprise the known organometallic compound methylcyclopentadienyl platinum trimethyl ($MeCpPtMe_3$). Other known compounds that may be used are methylcyclopentadienyl platinum triethyl ($MeCpPtEt_3$) and platinum acetylacetonate $Pt(acac)_2$. $MeCpPtMe_3$ is a liquid at 30° C. and has a sufficiently high vapor pressure for reactant transport and reaction. In one embodiment, the compound may vaporized at 35° C. and carried to the reactor in flowing argon gas (FIG. 3 provides a sketch showing the reactor system, which includes the contained platinum-containing precursor compound, the argon and oxygen gases whose flow is regulated using valves, and the substrate heater, as well as an exhaust for gas removal from the reactor system. A monolayer of the compound is adsorbed on the surfaces of the carbon nanotubes, which are heated to 350° C. After a brief purge of the reactor with argon gas, oxygen is introduced and reacts with the adsorbed compound forming a platinum film and $CO_2$, $H_2O$ and other hydrocarbon byproducts. The cycle is then repeated until the desired thickness is obtained. The use of the atomic layer deposition approach insures uniform and conformal deposition on the nanotubes and within the space between nanotubes.

The composite layer of SWNTs and platinum has a thickness of from about 10 microns to about 50 microns. Suitable examples of SWNTs are described in Paul McEuen, "Single-wall carbon nanotubes," Physics World, pp. 31-36 (June, 2000), incorporated herein by reference in its entirety. The platinum (109) in the composite layer is capable of forming a carbide layer between SWNTs and the platinum bulk when raised to a temperature 500° C. or above. After this carbide layer forms, the layer (109) and the layer including single-walled carbon nanotubes (111) become in direct contact with this carbide layer. This reaction and carbide formation creates a near perfect electrical contact between the platinum and the SWNTs due to the close match in work function between the materials. Loose SWNTs that are not at least partially embedded in or attached to the platinum layer are removed.

Next, a surface of the composite layer of SWNT's and platinum is seeded with nanocrystalline diamond by applying a slurry of nanocrystalline diamond in a gentle sonication and rinse process. The nanocrystalline diamond that remains becomes nucleation sites for the diamond crystal growth of the nanocrystalline diamond layer (113). The nanocrystalline diamond layer (113) serves as a semiconducting transition layer and functions as a charge reservoir.

Finally, layer (109) is deposited onto composite layer (111). Layer (109) is comprised of platinum. For this deposition, a physical vapor deposition process (PVD) may be used.

The nanocrystalline diamond layer (113) further comprises boron in an amount of from about $7\times10^{20}$ $cm^{-3}$ to about $8\times10^{21}$ $cm^{-3}$ to form a doped nanocrystalline diamond layer. In one embodiment, the nanocrystalline diamond layer (113) is n-doped, and forms an n-type nanocrystalline semiconductive surface. The n-type nanocrystalline diamond layer is an indirect bandgap semiconductor. The n-doped layer (113) may be formed by thermally diffusing deuterium to a depth of from about 10 angstroms to about 50 angstroms into a relatively less densely boron doped diamond bulk in the same region. Without wishing to be limited by theory, one advantage of the n-type device is that due to the indirect band gap, the electron/hole recombination takes place through means other than the radiative processes as with p-type devices, which are much slower and can be as long as a nanosecond. As such there can be many electrons at discrete energy levels at the bottom of the conduction band. Dangling carbon bonds remain unbound at the completion of the growth process. The dangling carbon bonds may be terminated with hydrogen. One non-limiting means of termination may be performed at the end of the diamond growth process with a microwave generated hydrogen plasma in the diamond reaction chamber. If destroyed, the hydrogen termination can be reestablished through a RF (radiofrequency) or d.c. (direct current) glow discharge process in a small chamber. This process results in a surface dipole and bends the vacuum level to below the conduction band minimum. This condition allows the electrons to fall into the vacuum level possessing only their intrinsic energy which would be only a small fraction of an electron volt whereby a very cold electron beam can be extracted. The n-type device is particularly adaptable to high frequency systems with periods on the order of a nanosecond or less. The quantum condition includes quantum non-local connection with the electrons throughout system so that "information" at the time of surface charge depletion is already "known" within the system, and equilibration processes, limited by charge mobility, are highly relevant. Additionally, the ability to illuminate the cathode back surface with a variable power continuous wave laser promotes uniform charge mobility within the diamond bulk through increased electron phonon interaction and simultaneously provides an elevated device temperature to drive off adsorbed surface contaminants.

In some embodiments involving the use of the electron beam sources of this invention, a laser provides electron pulses at the back contact surface (101). These electrons impinge on the layer (109) comprised of platinum. This will produce bremsstrahlung radiation, which comprises an x-ray continuum. Without wishing to be limited to any particular theory or explanation, it is believed that the x-ray photons resulting from interaction of the electron pulses with layer (109) would scatter efficiently through Bragg processes within the boron-doped diamond layer, promoting charge mobility in the boron-doped diamond layer and gating the electron emission at the vacuum surface coincidental to the peak RF electric field. (note; this functionality is becoming possible due to the concurrent technical advances in high brightness, very high frequency solid state lasers)

In all embodiments of the present invention, all percentages are by weight of the total composition, unless specifically stated otherwise. All ranges are inclusive and combinable. All numerical amounts are understood to be modified by the word "about" unless otherwise specifically indicated. All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

Whereas particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An electron source comprising:

a) a back contact surface comprising means for attaching a power source to said back contact surface;

b) a layer comprising platinum in direct contact with said back contact surface;

c) a layer comprising a composite of single-walled carbon nanotubes embedded in a platinum matrix in direct contact with said layer comprising platinum; and, d) a nanocrystalline diamond layer in direct contact with said composite layer, wherein said nanocrystalline diamond layer comprises boron dopant;

wherein at least a portion of said back contact surface is removed to reveal said layer comprising platinum.

2. The electron source of claim 1, wherein the back contact surface comprises gold and has a thickness of from about 100 microns to about 1 millimeter.

3. The electron source of claim 1, wherein said layer comprising platinum is a partially phototransparent layer.

4. The electron source of claim 1, wherein the doped nanocrystalline diamond layer comprises boron in an amount of from about $7\times10^{20}$ $cm^{-3}$ to about $8\times10^{21}$ $cm^{-3}$.

5. The electron source of claim 1, wherein the doped nanocrystalline diamond layer comprises deuterium diffused to a depth of from about 10 angstroms to about 50 angstroms.

6. The electron source of claim 1, wherein the doped nanocrystalline diamond layer comprises hydrogen-terminated carbon atoms.

7. The electron source of claim 1, wherein the emitted beam of electrons is of high quality.

8. The electron source of claim 1, further comprising a power source attached to said back contact surface.

9. The electron source of claim 1, further comprising an evacuable container for providing a vacuum environment for the electron source.

* * * * *